US011465877B2

(12) United States Patent
Hanninen et al.

(10) Patent No.: US 11,465,877 B2
(45) Date of Patent: Oct. 11, 2022

(54) ELEVATOR SYSTEM ACCOMMODATING ELEVATOR CARS HAVING DIFFERENT SIZES

(71) Applicant: Kone Corporation, Helsinki (FI)

(72) Inventors: Ari Hanninen, Helsinki (FI); Ilpo Haipus, Nummela (FI); Ari Koivisto, Helsinki (FI); Jouni Ratia, Helsinki (FI); Markku Haivala, Helsinki (FI)

(73) Assignee: Kone Corporation, Helsinki (FI)

( * ) Notice: Subject to any disclaimer, the term of this patent is extended or adjusted under 35 U.S.C. 154(b) by 1136 days.

(21) Appl. No.: 15/994,296

(22) Filed: May 31, 2018

(65) Prior Publication Data

US 2018/0273342 A1 Sep. 27, 2018

Related U.S. Application Data

(63) Continuation of application No. PCT/EP2015/079343, filed on Dec. 11, 2015.

(51) Int. Cl.
*B66B 9/00* (2006.01)
*B66B 9/10* (2006.01)
(Continued)

(52) U.S. Cl.
CPC ..... *B66B 1/2466* (2013.01); *B66B 1/2433* (2013.01); *B66B 1/468* (2013.01);
(Continued)

(58) Field of Classification Search
CPC ..... B66B 1/2466; B66B 1/2408–2491; B66B 1/307; B66B 2201/4653
See application file for complete search history.

(56) References Cited

U.S. PATENT DOCUMENTS 5,022,497 A * 6/1991 Thanagavelu ..... B66B 1/2458 187/382
7,621,376 B2 * 11/2009 Duenser ..... B66B 9/02 187/382
(Continued)

FOREIGN PATENT DOCUMENTS

CN 101875465 A 11/2010
CN 101885441 A 11/2010
(Continued)

OTHER PUBLICATIONS

International Search Report PCT/ISA/210 for International Application No. PCT/EP2015/079343 dated Jul. 27, 2016.
Written Opinion of the International Searching Authority PCT/ISA/237 for International Application No. PCT/EP2015/079343 dated Jul. 27, 2016.

*Primary Examiner* — Christopher Uhlir
(74) *Attorney, Agent, or Firm* — Harness, Dickey & Pierce, P.L.C.

(57) ABSTRACT

The invention refers to an elevator system having a plurality of elevator cars, which elevator cars comprise several first cars and at least one second car, which second car differs from the first cars in its size and/or technical configuration, whereby the first cars and the second car run together within one and the same elevator shaft, which elevator system comprises an elevator control comprising a call allocation control having a first part connected to at least one call input device for allocating the first elevator cars and a second part connected to at least one call issuing means for the call allocation of the second car, whereby the first and second part of the call allocation control are configured to work independently of each other.

16 Claims, 4 Drawing Sheets

(51) Int. Cl. *B66B 11/02*
(2006.01) *B66B 1/24*
(2006.01) *B66B 1/46*
(2006.01) *B66B 11/00*
(2006.01)

(52) U.S. Cl.
CPC ..... *B66B 9/003* (2013.01); *B66B 11/0005* (2013.01); *B66B 11/0226* (2013.01); *B66B 2201/00* (2013.01); *B66B 2201/102* (2013.01); *B66B 2201/103* (2013.01); *B66B 2201/104* (2013.01); *B66B 2201/4615* (2013.01); *B66B 2201/4653* (2013.01); *B66B 2201/4661* (2013.01)

(56) References Cited

U.S. PATENT DOCUMENTS

| | | | | |
|---|---|---|---|---|
| 9,884,744 | B2 * | 2/2018 | Witczak | B66B 19/005 |
| 10,196,233 | B2 * | 2/2019 | Witczak | B66B 11/0407 |
| 10,865,072 | B2 * | 12/2020 | Ericson | B66B 1/2491 |
| 2015/0068848 | A1 * | 3/2015 | Stanley | B66B 1/468 187/384 |

FOREIGN PATENT DOCUMENTS

| | | | |
|---|---|---|---|
| EP | 2230205 | A1 | 9/2010 |
| JP | 2875112 | B2 | 3/1999 |
| WO | WO-2007/130009 | A1 | 11/2007 |
| WO | WO-2007/132058 | A1 | 11/2007 |
| WO | WO-2013/112134 | A1 | 8/2013 |

* cited by examiner 40
12
18
26
46
22
48
42
44
20
28a
28b
50
52
42-48
28a,b
d
l

ELEVATOR SYSTEM ACCOMMODATING ELEVATOR CARS HAVING DIFFERENT SIZES

This application is a continuation of PCT International Application No. PCT/EP2015/079343 which has an International filing date of Dec. 11, 2015, the entire contents of which are incorporated herein by reference.

BACKGROUND OF THE INVENTION

The present application refers to an elevator system having a plurality of elevator cars whereby at least two elevator cars move independently of each other in a common elevator shaft. Such an elevator system is called multi-car system.

SUMMARY OF THE INVENTION

It is object of the present invention to improve a multi-car system in such a way that it better meets individual requirements. The object is solved with an elevator system according to claim 1. Preferred embodiments of the invention are subject matter of the dependent claims. Embodiments of the invention are also described in the specification and drawings.

According to the invention, the elevator system comprises several first cars and at least one second car, which second car differs from the first cars in its size and/or technical configuration. The first and second cars run together within one and the same elevator shaft mostly independent of each other, which means they may have different starting floors and departure floors. While the first cars are normal cars which are allocated during the normal operation of the elevator system, the at least one second car is a special car which is provided for a particular requests. Such a car could for example be a bed car or emergency car in a hospital, a cleaner car in a hospital, an executive car in cooperate headquarters, a food transportation car in hotels and hospitals, a goods transportation car for maintenance staff in larger buildings, mover cars in residential buildings having an essentially larger base area than the first cars. Thus the second car(s) differ from the first cars in that they are tailored according to special needs of the building. Of course, the call of a second car is comparably seldom, compared with the first cars.

While the first cars are rotating in the elevator shaft in a paternoster-like fashion as to be allocated via a first part of a call allocation control of the elevator (group) control, the second car is unaffected by the normal call allocation procedure performed by the first part of the call allocation control. Therefore, the second car could rest in a parking area unmoved, which has the advantage that the second car has not to be moved when it is not needed, which safes energy and costs. On the other hand the second car is not included in the normal call allocation of the first part of the call allocation control which reduces the calculating effort of the call allocation control.

Multi-car elevator systems can basically be built according to two different design alternatives:

In the first alternative the cars move in a loop in two adjacent vertical shaft parts which are at least at their upper and lower end connected by an upper and lower horizontal transfer passage. This alternative is quite similar to known Paternoster devices. The landing doors are located in the vertical shaft parts. This alternative has the advantage of a low space consumption but has the disadvantage that the stopping of a car at a floor blocks the moving loop.

The second alternative also comprises the at least two vertical shaft parts, but in this case the vertical shaft parts are connected by intermediate horizontal transfer passages located between the vertical shaft parts, whereby the landing doors are provided in sais horizontal transfer passages. This embodiment has the advantage that the cars stop in the horizontal transfer passages so that the moving loop in the vertical shaft parts is not blocked by stopping cars. The disadvantage is that this solution necessitates more space than the first alternative.

The parking area could for example be in a horizontal transfer passage of a floor which is very rarely used. Parking areas could also be provided in the top or bottom of the elevator shaft preferably outside of the moving loop of the cars in the two vertical shaft parts and the upper and lower horizontal transfer passages. The parking area could even be located offset of the vertical extension of the elevator shaft. Thus, a kind of parking maintenance and cleaning area could be located in the base of the building offset of the vertical extension of the elevator shaft in which area the second cars can be equipped, maintained, cleaned, repaired or sterilized. In this area not only the second cars but also the first cars could be maintained.

Preferably, a horizontal moving mechanism is provided in the elevator system to move the car to be parked from the moving loop in the elevator shaft into the parking or maintenance or cleaning area and vice versa. This embodiment has the advantage that the second car does not need to run in the loop together with the first cars which needs a lot of energy so that this preferred inventive solution is energy-saving. The parked second car is on the other hand immediately ready to be allocated in response to a call issued via the car call issuing means. This car call issuing means could for example be a special key, a button which is only accessible by certain persons, or a wireless transmitter which is able to give a call to the call allocation control as to order the second car to a specified departure floor and possibly to a specified destination floor.

Preferably, the first part of the call allocation control is a destination call allocation control wherein the call input device receives the departure floor as well as the destination floor in connection with a car call. These destination calls are usually issued via destination operating panels in the elevator lobby. Via this measure, the call allocation control always knows the destinations and departures of the first cars and can monitor whether such a location or the movement between departure floor and destination floor collides with the parking position of a second car.

Generally multi-car systems are able to handle a high traffic volume necessitating comparably small space in the building for the complete elevator system. This is based on the fact that in the two vertical elevator shaft parts, for example seven cars can be running independently of each other which normally would require seven separate elevator shafts. Even if the landing doors are between the two elevator shaft parts, the total space consumption would be three elevator shafts whereby this solution is advantageous as for a stop of an elevator car at a landing, the corresponding car does not block the loop in the two vertical shaft parts but is transferred by a horizontal moving mechanism into the intermediate part where the landing doors are located.

Preferably, the call allocation control or the elevator control comprises a synchronizing unit controlling the activity of the first and second part of the call allocation control as to synchronize the movement of the first and second cars in the common elevator shaft. As the first and second part of the call allocation control work independently of each other, it could happen in the worst case that a first car and a second car is moved to the same location at the same time. To exclude this possibility of a collision, the synchronizing unit supervises the first and second part of the call allocation control and secures that the first and second cars are allocated in a way that the movement of the first cars and second cars is smooth and no collision takes place.

Preferably, the car call issuing means is a key-switch or a movable wireless call issuing device, for example a transmitter, co-acting with a receiver connected with the elevator system. For example, handicapped persons or medical staff could carry such a movable call issuing device and issue a call to a certain car, for example an emergency car where for example life sustaining equipment is provided. Another possibility would be to provide a very large second elevator car which has enough space to accommodate an emergency bed together with the life sustaining equipment moving together therewith.

In a preferred embodiment of the invention, the second car has an elevator door on a different side than the first elevator cars. In this case, the second elevator car provides access to areas which are not accessible via the normal call allocation of the first elevator cars. For example, such a car could be used in a hospital to provide direct access to an operation to a surgery room or it could be an executive car where the second car provides access to an executive floor which is not accessible by the normal employees via the first cars. Therefore, in this preferred embodiment, the use of different cars could also provide a kind of access control in the building.

It is clear for the skilled person that different second cars could be provided, for example in a hospital. In a hospital, several second cars for example with life sustaining equipment, with a larger base area, cleaner cars or goods transportation cars could be provided in a hospital beside the normal first cars which are provided for transporting patients and visitors.

In a preferred embodiment, the second car is parked in a parking area located in an intermediate passage of a seldom used floor which of course only holds true for a multi-car system where the landing doors are located between two vertical elevator shaft parts. In this case, no additional parking area has to be provided for the second car, but the second car is simply parked in an area which is seldomly used in the elevator system. In this case, it is advantageous if the call allocation control comprises an allocation history unit whereby the elevator control selects the parking position of the second elevator car from the call history unit as the floor with the lowest allocation target numbers. Via this measure it can be ensured that the second car is indeed parked in a parking area which is very rarely used in the elevator system.

In this case, the parked second elevator car is automatically driven to a different, preferably also seldomly used floor level, if a call input by a call input device includes the floor where the second car is parked. As the call allocation control monitors the action of the first and second part of the call allocation control, it immediately recognizes if by the first part a call is issued which collides with position of a second car which is evident from the data in the second part of the call allocation control. In this case, a synchronizing unit of the call allocation control automatically drives the parked second car to a different floor, particularly also a seldomly used floor of the elevator system. Via this measure, the normal use of the building is not affected by the parked second car of the elevator system.

In a preferred embodiment, each elevator car carries an ID tag with a unique ID indicating the type of the elevator car, i.e. whether the elevator car is a first car or a second car. Via this measure, the different cars of the elevator system can easily be identified by the elevator control.

In a preferred embodiment of the invention, the elevator shaft or a vertical part of the elevator shaft comprises a parking area for parked cars aside or offset of the movement loop of the elevator cars in the elevator shaft. Such a parking area could for example be in an intermediate horizontal transfer passage of a rarely used elevator floor or it could be in a particular position of the elevator shaft which is aside of the movement loop of the elevator cars. Thus, the parking area could for example be an additional area provided in the bottom of the elevator shaft below the movement loop of the elevator cars. The parking area could even reach horizontally aside the elevator shaft whereby the parked elevator cars can be moved by a horizontal transfer mechanism from the elevator shaft into the horizontally offset parking area. In this case, the parking area could be provided very voluminous as to comprise optionally a cleaning area, a maintenance area, an equipment area, for example for hospitals, so that the first as well as the second elevator cars can be parked, maintained, equipped or cleaned according to the special requirements of a building, for example of an office building or of a hospital. Therefore, the present invention offers a variety of possibilities of introducing different second elevator cars for special needs or requirements in a standard elevator system without affecting the performance of the elevator system. By the fact that preferably the second cars are parked when not in use, this particularly advantageous invention also improves the energy efficiency of the elevator system. Preferably also the number of running first cars can be controlled as to optimally meet the day-time requirement of transport capacity. Thus during heavy traffic times 15 first cars may run in the moving loop whereas in the night time the number may be reduced to five, with the other ten first cars being parked in the parking area offset to the vertical shaft parts. The use of the parking area to control the number of the active first cars may constitute an independent invention without taking regard of the second cars.

It shall be clear for the skilled person that the above-mentioned embodiments of the invention can be combined with each other arbitrarily. It shall further be clear for the skilled person that electronical components of the elevator system as for example the elevator control, the call allocation control, the first and second part of the call allocation control, the synchronizing unit can be located in separate electronic modules at a common location or at separate locations or these components could be integrated with each other in a single or distributed elevator control device.

In a preferred embodiment of the invention the elevator shaft may comprises a handling/parking area configured only for the parking of special second cars, as e.g. bed cars, which handling/parking area may then have a handling section which is configured to deal with the special second car, e.g. a cleaning or disinfection section.

The term moving loop is short for the vertical shaft parts and the upper and lower horizontal transfer passages in which the cars are moving in a loop.

It shall further be noted that this kind of multi-car elevator system is preferably intended for high-rise elevators with more than 20 floors where the use of several cars in an elevator shaft has a particular advantageous effect, although the invention may also have an advantageous effect in an elevator with less than 20 floors.

BRIEF DESCRIPTION OF THE DRAWINGS

The invention is hereinafter described in the drawings.

DESCRIPTION OF THE PREFERRED EMBODIMENTS

Figure 1:
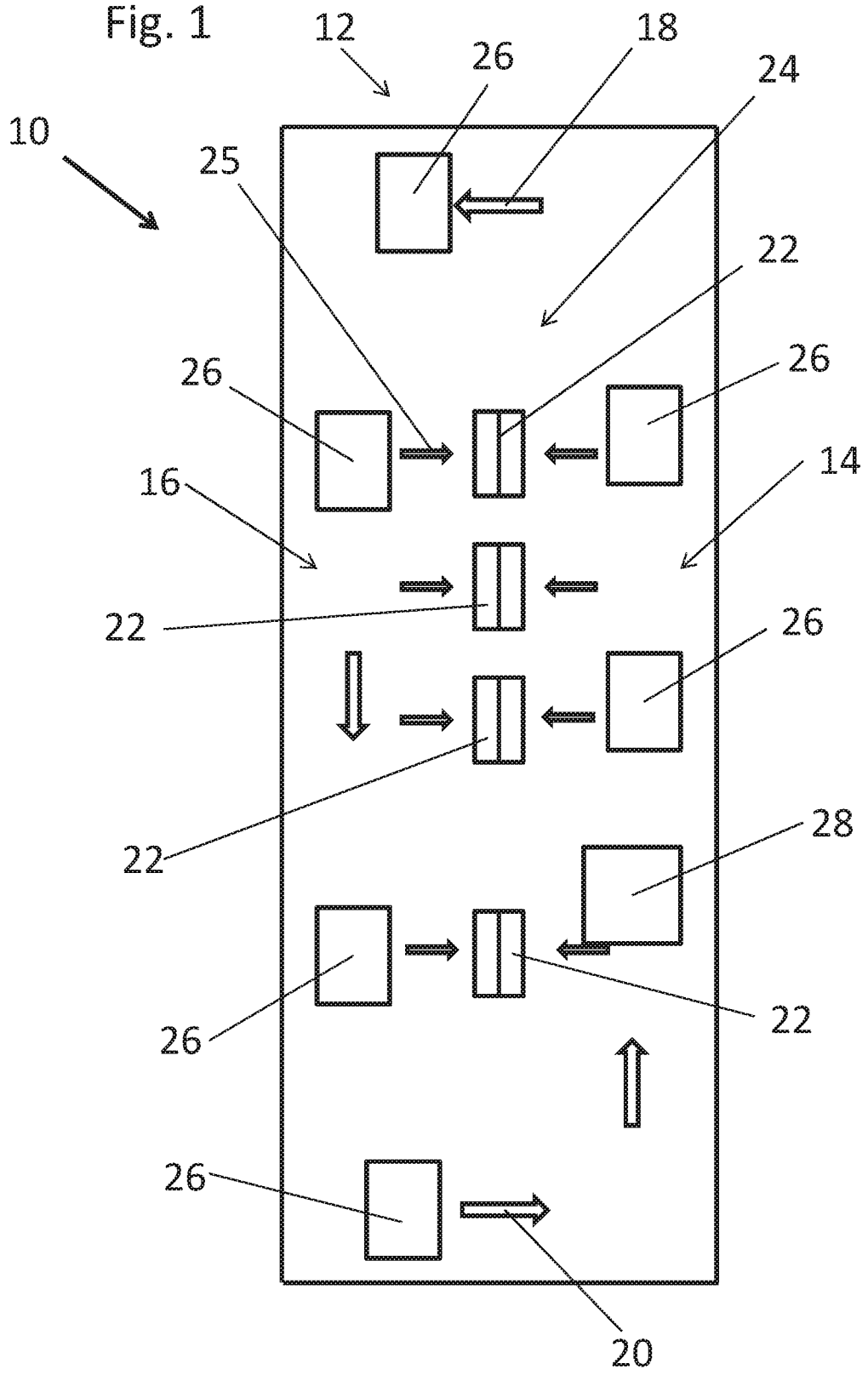
FIG. 1 shows a schematic side view to an elevator multi-car system with a moving loop having two vertical shaft parts and an upper and lower horizontal transfer passage whereby the landing doors are located in an intermediate portion between the two vertical elevator shaft parts, FIG. 2 the elevator system of FIG. 1 showing three optional parking positions for an unused second car having a larger size than the first cars, FIGS. 3A-3B an elevator system having four vertical shaft parts with seven first cars and two second cars which are parked in a parking area being horizontally offset with respect to the vertical elevator shaft parts, FIGS. 4A-4B an elevator system similar to FIG. 3 whereby the horizontally offset parking area additionally comprises a cleaning area, a maintenance area and an equipment area for modifying or gearing an elevator car for special requirements.

FIG. 1 shows an elevator system 10 having an elevator shaft 12 comprising a first shaft part 14 wherein elevator cars of the elevator system 10 move upward, a second elevator shaft part 16 where the cars of the elevator system move downward, an upper horizontal transfer passage 18 and a lower horizontal transfer passage 20 located in the bottom of the elevator shaft. These vertical and horizontal passages 14, 16, 18, 20 form the moving loop for the cars in the shaft 12. The landing doors 22 are located in an intermediate section 24 located between the first and second elevator shaft parts 14, 16. The elevator system 10 comprises identical first elevator cars 26 and a second elevator car 28 having a larger base area than the first cars 26. The cars 26, 28 are moving along the loop of the first and second elevator shaft part 14, 16 and the upper and lower transfer passage 18, 20. When a car is to serve a call, it is moved via a not shown horizontal moving mechanism to the intermediate section 24 as to be located in front of a landing door 22 to allow passengers to exit/enter the car.

Figure 2:
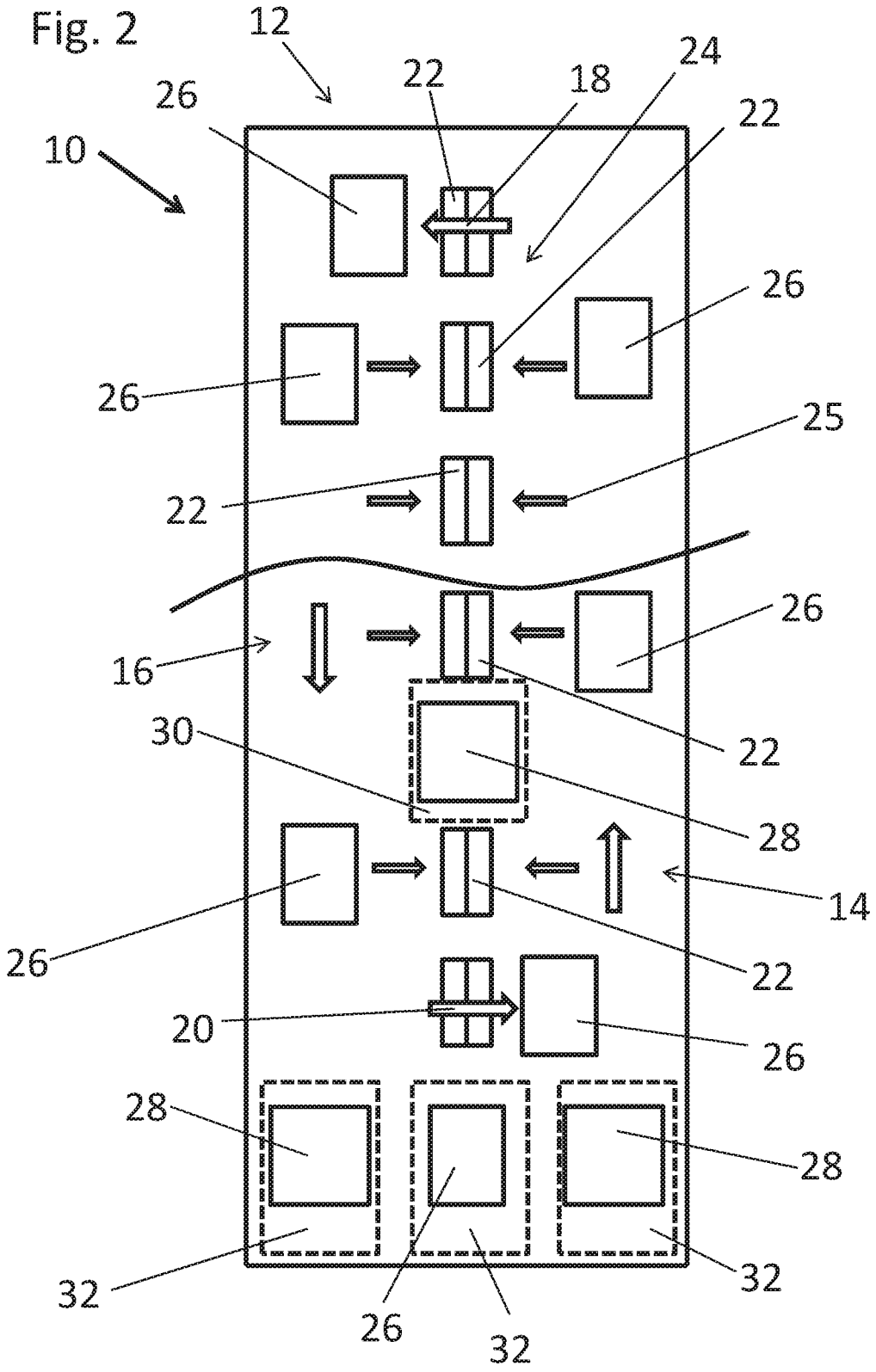

FIG. 2 shows the elevator system according to FIG. 1 wherein possible parking areas at least for the second elevator car are shown. Thus, the second elevator car 28 could be parked in a first parking area 30 located in front of a landing door 22 of the intermediate section 24 of the elevator shaft 12. Preferably, the first parking area 30 is located in a floor which is seldomly used so that the parked second car does not affect the normal operation of the elevator system by the blocking of the corresponding landing door 22 of said floor. If, however, a call to said floor should be input which requires a first car 26 to go there the second car 28 could be automatically moved to a different landing door, preferably also of a seldomly used floor. FIG. 2 also shows three alternative second parking areas 32 in the shaft pit below the movement loop 14, 16, 18, 20 of the elevator system (indicated by arrows). In this embodiment, the elevator system 10 would provide three second parking areas 32 in the shaft pit as well as several first parking areas 30 in the area of a landing door of a seldomly used floor. The second parking area in the shaft pit has the advantage that these second parking areas are really unaffected by the normal operation (moving loop) of the cars in the elevator system. Therefore, cars parked in said second parking area could be maintained, cleaned, repaired or equipped according to requirements in the building. Although these first and second parking areas 30, 32 are intended for the parking of the second cars 28, it is of course also possible to use these areas for the parking of the first cars 26, particularly if a first car has to be repaired or cleaned or equipped or maintained.

Figures 3A, 3B:
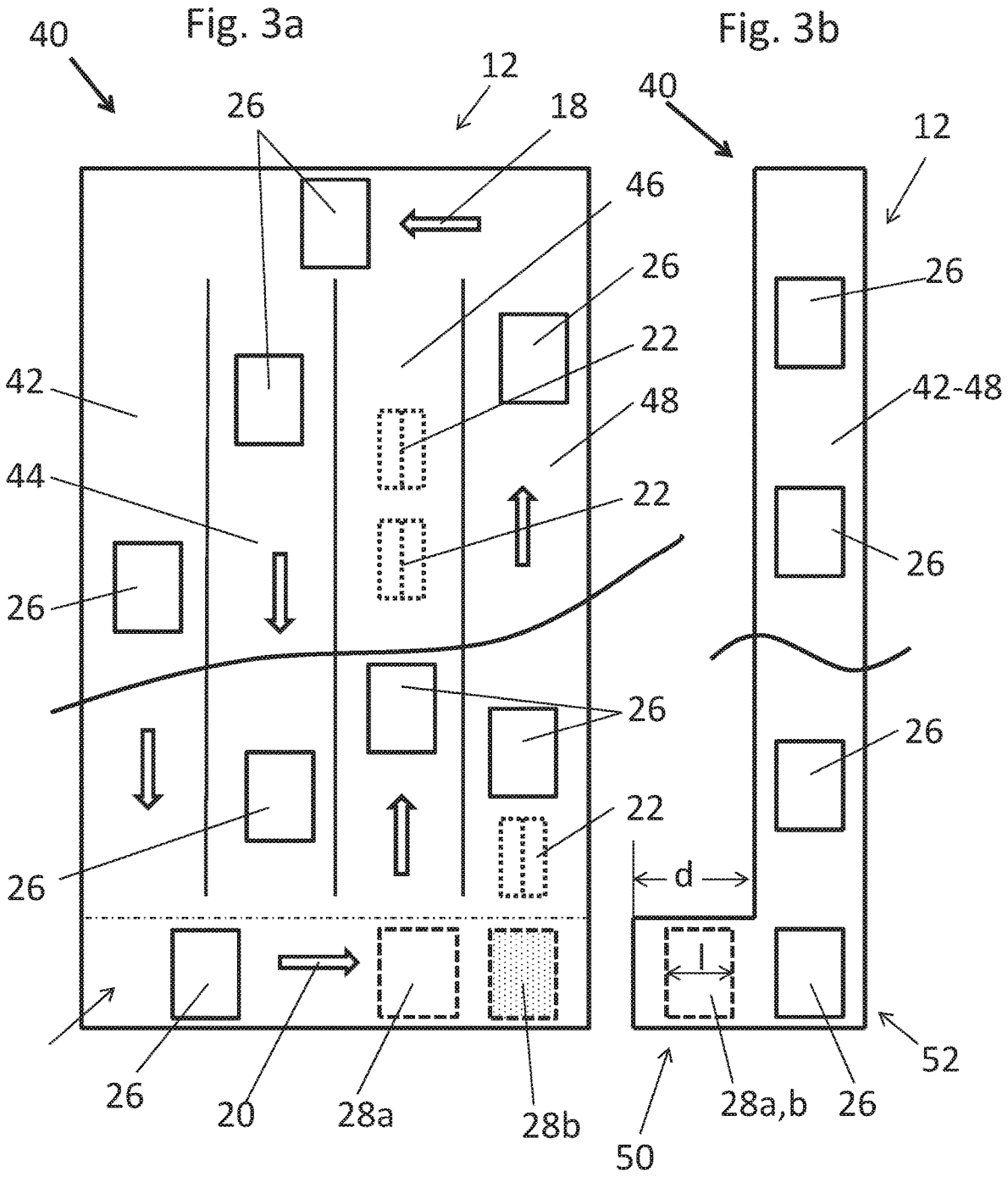

FIGS. 3A and 3B show a second embodiment 40 of an elevator system comprising four vertical elevator shaft parts 42 to 48 which are connected by an upper horizontal transfer passage 18 and a lower horizontal transfer passage 20. Therefore, the movement loop for the first elevator cars 26 and the second elevator car 28 extend in variable loops from the first vertical shaft part 42 to the fourth vertical shaft part 48 and the upper and lower horizontal transfer passage. In this connection, it is to be mentioned that in all figures identical or functionally similar parts carry the same reference numbers.

In this embodiment, the landing doors 22 are located in the vertical shaft parts 42 to 48 so that a stop of an elevator car 26, 28 at a landing 22 shortly blocks the corresponding vertical shaft part 42 to 48 during the time of the stop of the elevator car. Of course, such a system with several vertical elevator shaft parts can also be embodied according to FIG. 2 with the landing doors located in an intermediate section 24 between the vertical shaft parts.

In contrast to the embodiment of the FIG. 2, this embodiment 40 of an elevator system shows a parking area 50 which is located aside of the shaft pit 52 and which is horizontally offset to the vertical elevator shaft parts 42 to 48 via the length d. The advantage of this horizontally offset parking area 50 is that this area is absolutely unaffected by the vertical movement of the cars in the vertical shaft parts 42 to 48. Therefore, this horizontally offset parking area 50 is very safe as no cars are moving above it. Thus, parked elevator cars can be maintained or cleaned or equipped. Preferably, the length of the horizontal offset d corresponds at least the length l of the largest elevator car 26, 28. The embodiment of FIG. 3 shows a first second elevator car 28*a* having a larger base area than the first elevator car 26 as well as an alternative second car 28*b* which comprises a particular equipment for the transport of emergency patients in a hospital. Therefore, this elevator system 40 of FIG. 3 comprises beside the normal first elevator cars 26 two different kinds of second elevator cars 28*a*, 28*b* for different particular purposes.

Figure 4A:
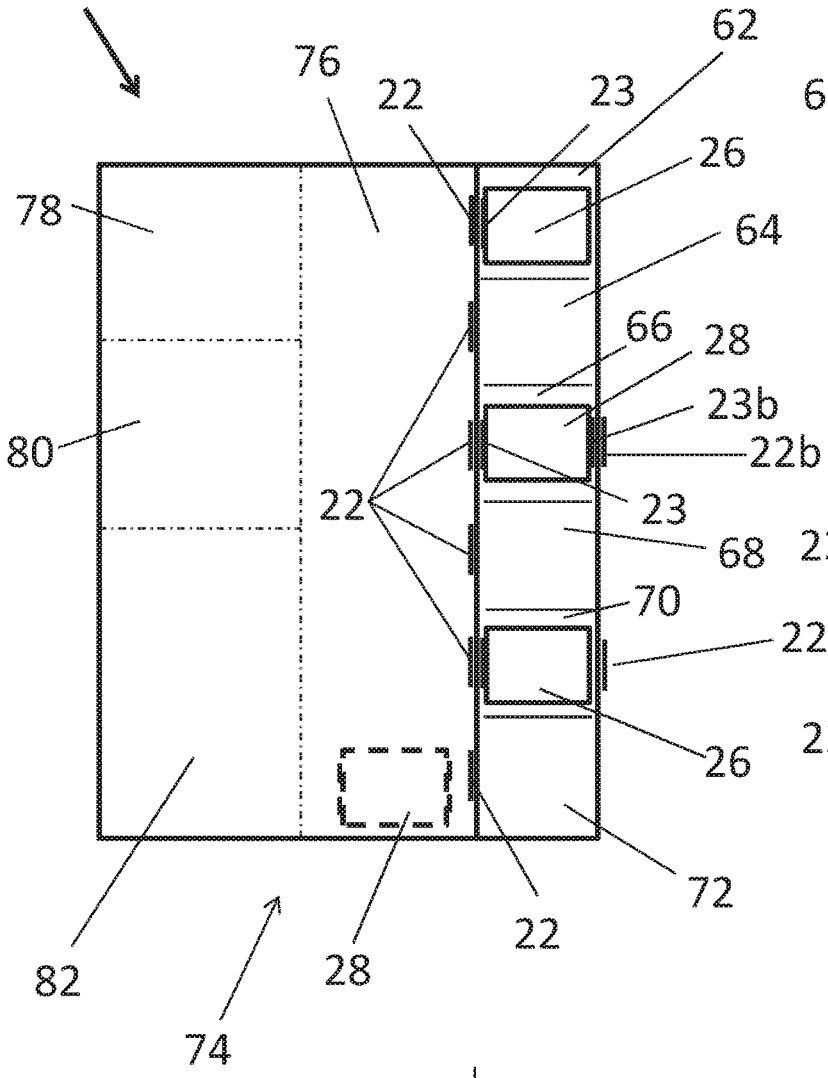
Figure 4B:
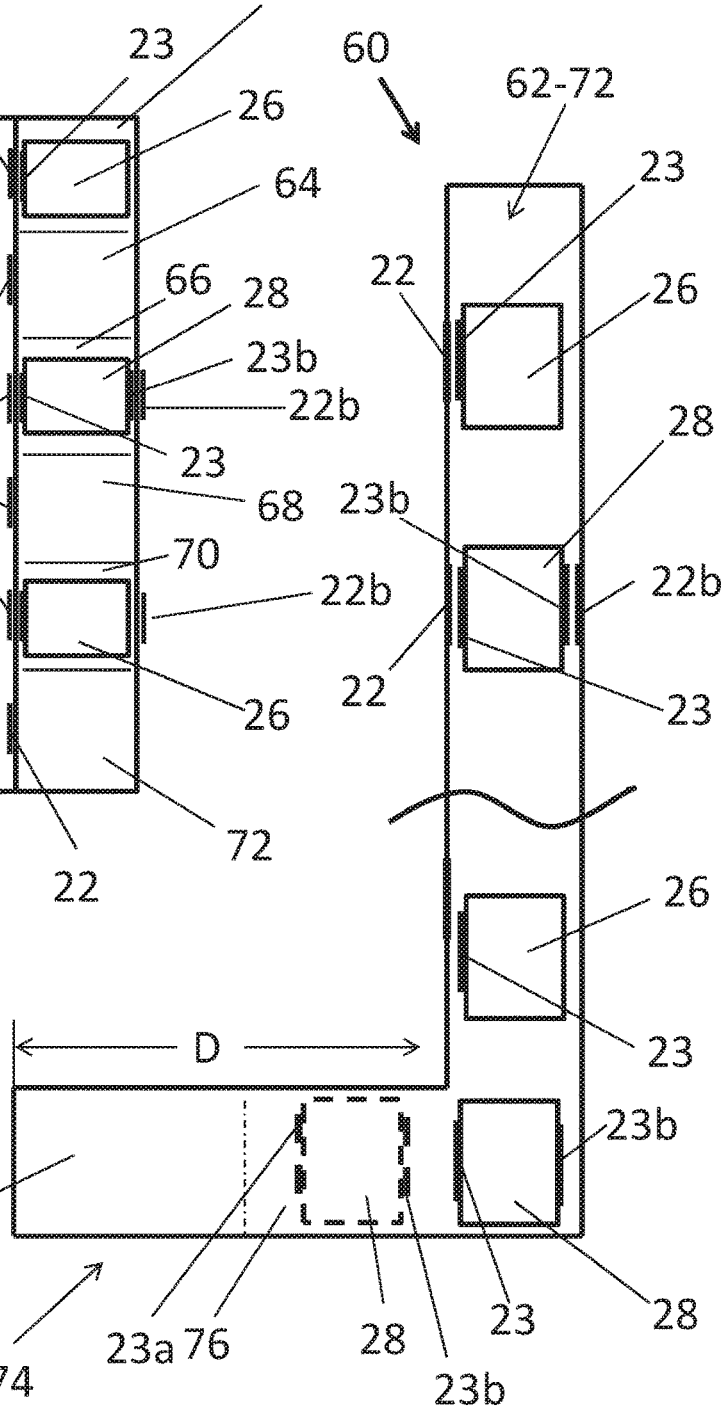

Finally, FIG. 4 shows an embodiment of an elevator system 60 having six vertical elevator shaft parts 62 to 72 and a large horizontal offset handling area 74 which is horizontally offset with respect to the vertical elevator shaft parts 62 to 72 by the depth D. The depth D of the horizontal offset of the handling area 74 is a multiple of the length l of the elevator car, i.e. four or five times the length l of a car. This large handling area 74 comprises different types of areas as specified in FIG. 4A. Thus, the handling area 74 has a parking section 76 which allows the parking of six second elevator first or second cars 26, 28, a maintenance section 78 wherein first as well as second elevator cars 26, 28*a,b* can be maintained and repaired, a cleaning section 80 where the inside of the parked cars 26, 28 can be cleaned or sterilized which is particularly important for hospital use. Further, the handling area 74 comprises an equipment section 82 where elevator cars can be provided with different equipment as for example beds, life ensuring devices, gas supplies as for example oxygen for emergency cases or even with power supply for supplying energy consuming medical devices. Thus, the sophisticated elevator system 60 with the handling area 74 of FIG. 4 does not only provide a safe and accessible parking section 76 but also different kinds of handling sections 78, 80, 82 which allow the maintenance, cleaning and modification of elevator cars according to the special needs of a building. The advantage of this particular embodiment is further that the parking as well as the handling of the elevator cars can be performed without interrupting or affecting the normal operation of the elevator system 60, as the areas are not affected by the traffic in the movement loops 18, 20, 62-72. It has to be mentioned that this embodiment of an elevator system is more advantageous the more floors are provided in the building as in this case the portion of the handling area 74 with respect to the area of the vertical shaft parts 62-72 in the building becomes relatively small. It has further to be mentioned that the handling area 74 which is quite voluminous can be located in a base part of the building for example in the second base floor where the available room is cheap compared with room in the first basement or in the ground floor.

Furthermore in the elevator system 60 of FIG. 4 the floors have regular landing doors 22 which are aligned with corresponding car doors 23 of the cars 26, 28. In the vertical shaft parts 62 to 72 also second landing doors 22*b* are provided which are access controlled. These second landing doors 22*b* give access e.g. to surgery rooms or to an executive floor. These second landing doors can only be served by second cars 28 which have a second car door 23*b* located e.g. opposite of the car door 23 as to be aligned with the second landing door 22*b* when the car 28 stops at said floor. Thus, in this embodiment 60 the second cars 28 give access to certain access restricted areas via the second car doors 23*b* which are missing in the first elevator cars. The second cars can be accessed e.g. only by medicines in a hospital or by executives in a corporate building, e.g. via mobile transmitters issuing a destination call to a second car.

It is clear for the skilled person that the above embodiments can be combined arbitrarily. The invention is not restricted to the disclosed embodiments but can be varied within the scope of the appended patent claims.

LIST OF REFERENCE NUMBERS

10 elevator system (first embodiment)
12 elevator shaft
14 first vertical shaft portion
16 second vertical shaft portion
18 upper horizontal transfer passage
20 lower horizontal transfer passage
22 landing door
22*b* second landing door
23 car door
23*b* second car door
24 intermediate section
25 intermediate horizontal transfer passage
26 first car
28*a* first second car
28*b* alternative second car
30 first parking area in an intermediate horizontal transfer passage
32 second parking area in the shaft pit
40 elevator system (second embodiment)
42-48 vertical shaft portions
50 horizontally offset parking area
52 shaft pit
60 elevator system (third embodiment)
62-72 vertical shaft portions
74 horizontally offset car handling area
76 parking section
78 maintenance/repair section
80 cleaning section
82 equipment section

The invention claimed is:

1. An elevator system, comprising:

a plurality of elevator cars, the plurality of elevator cars including a plurality of first cars and a second car, wherein the plurality of first cars and the second car are configured to run together within one elevator shaft such that the plurality of first cars and the second car are each configured to move vertically through at least a same vertical shaft part of the one elevator shaft, wherein the second car differs from each first car of the plurality of first cars based on the second car having a different size than each first car of the plurality of first cars, such that the second car has a larger base area than each first car of the plurality of first cars; and an elevator control, the elevator control including a call allocation control, the call allocation control including a first part connected to at least one call input device configured to allocate the plurality of first cars, and a second part connected to at least one call issuing means for call allocation of the second car, wherein the first part and the second part of the call allocation control are configured to work independently of each other, wherein the one elevator shaft includes at least two vertical elevator shaft parts that are connected by an upper horizontal transfer passage, and connected by a lower horizontal transfer passage, and the plurality of first cars and the second car are configured to run together simultaneously in a multi-car arrangement in a closed loop through the at least two vertical elevator shaft parts, the upper horizontal transfer passage, and the lower horizontal transfer passage of the one elevator shaft.

2. The elevator system according to claim 1, wherein the second car is configured to be parked in a park position when no call is issued by the at least one call issuing means.

3. The elevator system according to claim 1, wherein the call allocation control or the elevator control includes a synchronizing unit configured to control an activity of the first part and the second part of the call allocation control to synchronize movements of the plurality of first cars and the second car in the one elevator shaft.

4. The elevator system according to claim 1, further comprising landing doors that are between the at least two vertical elevator shaft parts in an area of intermediate horizontal transfer passages, wherein the elevator system is configured to move each car of the plurality of elevator cars in the closed loop and further horizontally move each car between the closed loop and separate, respective landing doors of the landing doors via separate, respective intermediate horizontal transfer passages of the area of intermediate transfer passages.

5. The elevator system according to claim 1, wherein the at least one call issuing means is a key-switch or a movable wireless call issuing device configured to co-act with a receiver connected with the elevator system.

6. The elevator system according to claim 1, wherein the second car has a different door arrangement than each first car of the plurality of first cars, wherein the plurality of first cars and the second car each include a separate first car door on a first car side in relation to a first shaft side of the one elevator shaft and the one elevator shaft has corresponding first landing doors at the first shaft side, and the second car further includes a second car door on a different car side in relation to a second shaft side of the one elevator shaft than respective car doors of the plurality of first cars and the one elevator shaft has a corresponding second landing door with limited access rights at the second shaft side.

7. The elevator system according to claim 1, wherein the second car has different equipment included in the second car than each first car of the plurality of first car.

8. The elevator system according to claim 1, wherein the second car is configured to be parked at a parking position on an intermediate horizontal transfer passage of a parking position floor of the elevator system.

9. The elevator system according to claim 8, wherein the call allocation control includes an allocation history unit, and the elevator control is configured to select the parking position floor of the parking position of the second car from the allocation history unit as a floor of the elevator system that is associated with a lowest allocation target numbers of respective allocation target numbers of the plurality of elevator cars.

10. The elevator system according to claim 8, wherein the elevator control is configured to automatically drive the second car from the parking position floor to a different floor level, in response to a call input by a call input device of the elevator system that includes the parking position floor where the second car is parked.

11. The elevator system according to claim 1, wherein each elevator car of the plurality of first cars and the second car carries an ID tag with a unique ID indicating an elevator car type of the elevator car.

12. The elevator system according to claim 1, wherein the first part of the call allocation control is a destination call control.

13. The elevator system according to claim 1, wherein the one elevator shaft comprises a handling/parking area for cars, wherein the handling/parking area is horizontally offset from a vertical extension of the at least two vertical elevator shaft parts of the one elevator shaft.

14. The elevator system according to claim 1, comprising a maintenance and/or cleaning section for cars, wherein the maintenance and/or cleaning section is horizontally offset from a vertical extension of the at least two vertical elevator shaft parts f the one elevator shaft.

15. The elevator system according to claim 1, further comprising:

a handling area for the plurality of first cars and the second car, the handling area being horizontally offset from the at least two vertical elevator shaft parts of the one elevator shaft, wherein the handling area includes at least one section of a parking section, a maintenance section, a cleaning section, an equipment section, wherein the handling area includes a horizontal moving mechanism configured to move a car, of the plurality of elevator cars, horizontally between an operating position in the vertical elevator shaft parts and the at least one section of the handling area.

16. The elevator system according to claim 1, wherein the one elevator shaft includes a handling/parking area configured only for parking of the second car.

* * * * *